US012090358B2

(12) United States Patent
Zhou

(10) Patent No.: US 12,090,358 B2
(45) Date of Patent: Sep. 17, 2024

(54) QUICK ASSEMBLY AND DISASSEMBLY CONNECTING STRUCTURES AND WEIGHT ADJUSTABLE DUMBBELL

(71) Applicant: Jine Zhou, Zhejiang (CN)

(72) Inventor: Jine Zhou, Zhejiang (CN)

( * ) Notice: Subject to any disclaimer, the term of this patent is extended or adjusted under 35 U.S.C. 154(b) by 132 days.

(21) Appl. No.: 18/091,394

(22) Filed: Dec. 30, 2022

(65) Prior Publication Data

US 2023/0285794 A1 Sep. 14, 2023

(30) Foreign Application Priority Data

Mar. 10, 2022 (CN) ..... 202220521269.4

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0728* (2013.01)

(58) Field of Classification Search
CPC ..... A63B 21/075; A63B 21/0724; A63B 21/0728; A63B 21/0726
See application file for complete search history.

(56) References Cited

U.S. PATENT DOCUMENTS

2014/0031177 A1* 1/2014 Wang ..... A63B 21/075 482/107
2017/0239511 A1* 8/2017 Svenberg ..... A63B 21/072
2018/0353794 A1* 12/2018 Wang ..... A63B 71/0036
2022/0331641 A1* 10/2022 Weng ..... A63B 21/075

* cited by examiner

*Primary Examiner* — Andrew S Lo

(57) ABSTRACT

Quick assembly and disassembly connecting structures and a weight adjustable dumbbell; each connecting structure include a male structure and a female structure respectively on its two sides; the male structure includes a plug-in part; the female structure includes an insertion groove, a lock button and lock button restoring springs; during assembly, the plug-in part of a connecting structure inserts into the insertion groove of another connecting structure; a lock button of said another connecting structure abuts a top side of the plug-in part to prevent it from falling out; when pushing the lock button away from the plug-in part, the lock button is separable from the insertion groove, and stops abutting the top side of the plug-in part to make it separable; the lock button restoring springs biases the lock button towards the plug-in part and resets the lock button towards the plug-in part when external force is not applied.

10 Claims, 9 Drawing Sheets

QUICK ASSEMBLY AND DISASSEMBLY CONNECTING STRUCTURES AND WEIGHT ADJUSTABLE DUMBBELL

BACKGROUND OF THE INVENTION

The present invention relates to the field of fitness equipment, and more particularly a plurality of quick assembly and disassembly connecting structures and a weight adjustable dumbbell.

Weight adjustable dumbbells are popular among consumers for being accommodative to the fitness needs of different groups of people. Currently, most of the weight adjustable dumbbells commonly found on the market contain problems of complicated connecting structure, inconvenient disassembly and inability to be quickly adjusted, which need to be improved by those skilled in the art.

BRIEF SUMMARY OF THE INVENTION

It is an object of the present invention to overcome the above problems in the prior art by providing a plurality of quick assembly and disassembly connecting structures and a weight adjustable dumbbell using the said quick assembly and disassembly connecting structures to achieve simple and quick separable connections between every two adjacent dumbbell weight plates thereof.

To attain the above object, the present invention provides the following technical solutions:

A plurality of quick assembly and disassembly connecting structures, wherein each connecting structure comprises a male structure and a female structure connectable with each other; the male structure comprises a plug-in part; the female structure comprises an insertion groove, a lock button, and a pair of lock button restoring springs; when two adjacent connecting structures are connected to each other, the plug-in part of one of the two adjacent connecting structures inserts into the insertion groove of another one of the two adjacent connecting structures; the lock button of said another one of the two adjacent connecting structures protrudes to a space above the insertion groove of said another one of the two adjacent connecting structures, and abuts a top side of the plug-in part of said one of the two adjacent connecting structures, so that the plug-in part of said one of the two adjacent connecting structures is blocked from falling off; when pushing the lock button of said another one of the two adjacent connecting structures away from the male structure of said one of the two adjacent connecting structures, the lock button of said another one of the two adjacent connecting structures is moved away from the space above the insertion groove of said another one of the two adjacent connecting structures, and the lock button of said another one of the two adjacent connecting structures no longer abuts the top side of the plug-in part of said one of the two adjacent connecting structures, so that the plug-in part is in a separable state; the pair of lock button restoring springs of said another one of the two adjacent connecting structures biases the lock button of said another one of the two adjacent connecting structures towards the male structure of said one of the two adjacent connecting structures such that the lock button of said another one of the two adjacent connecting structures resets towards the male structure of said one of the two adjacent connecting structures when no external force is applied to the lock button of said another one of the two adjacent connecting structures.

Further, the lock button of said another one of the two adjacent connecting structures moves away from or towards the male structure of said one of the two adjacent connecting structures by horizontal translation.

Further, a moving direction of the lock button of said another one of the two adjacent connecting structures is perpendicular to a moving direction of the plug-in part of said one of the two adjacent connecting structures inserting into the insertion groove of said another one of the two adjacent connecting structures.

Further, the insertion groove of said another one of the two adjacent connecting structures opens at a top side thereof, and also opens at a lateral side towards the male structure of said one of the two adjacent connecting structures; the plug-in part of said one of the two adjacent connecting structures is a tenon fitting a shape of the insertion groove of said another one of the two adjacent connecting structures.

Further, the lateral side of the insertion groove of said another one of the two adjacent connecting structures that opens towards the male structure of said one of the two adjacent connecting structures comprises a narrower opening part and a wider opening part interior to the narrower opening part widened with respect to the narrower opening part; the plug-in part of said one of the two adjacent connecting structures comprises a narrower head part and a wider head part widened with respect to the narrower head part, fitted correspondingly to the narrower opening part and the wider opening part of the insertion groove of said another one of the two adjacent connecting structures respectively.

A weight adjustable dumbbell, comprising a handle and a plurality of dumbbell weight plates respectively on two sides of the handle; on each side of the handle, a first dumbbell weight plate nearest to the handle is a non-separable fixed plate, and all additional dumbbell weight plates arranged on the same side additional to the first dumbbell weight plate are separable adjusting plates; the fixed plate and an adjacent separable adjusting plate, as well as every two adjacent separable adjusting plates, are in each case connected to each other by connecting two adjacent connecting structures.

Further, when the fixed plate and the separable adjusting plate adjacent to the fixed plate are connected to each other by connecting two adjacent connecting structures, the male structure of said one of the two adjacent connecting structures is provided on a side of the separable adjusting plate, and the female structure of said another one of the two adjacent connecting structures is provided on a side of the fixed plate; wherein the plug-in part of said one of the two adjacent connecting structures is convexly provided on the side of the separable adjusting plate facing towards the fixed plate, and the insertion groove of said another one of the two adjacent connecting structures is concavely provided on the side of the fixed plate facing towards the separable adjusting plate; the lock button of said another one of the two adjacent connecting structures is horizontally movably disposed in a preset sliding groove provided on a top side of the fixed plate; the pair of lock button restoring springs of said another one of the two adjacent connecting structures is provided in the fixed plate and in abutting connection with the lock button of said another one of the two adjacent connecting structures.

The insertion groove of said another one of the two adjacent connecting structures is defined by a recess extending down to the fixed plate from an opening on the top side of the fixed plate; the preset sliding groove is recessed into a top side surface of the fixed plate, and is in communication with a portion of the perpendicularly arranged insertion groove away from the separable adjusting plate; a bottom side wall of the preset sliding groove is provided with a pair of openings so that a lower part of the lock button is inserted into the fixed plate through the pair of openings; the pair of lock button restoring springs of said another one of the two adjacent connecting structures is provided in the fixed plate and abuts against a pair of inserting ends provided on the lower part of the lock button of said another one of the two adjacent connecting structures.

Further, when every two adjacent separable adjusting plates are connected to each other by connecting two adjacent connecting structures, the male structure of one of the two adjacent connecting structures is provided on a side of the separable adjusting plate distal from the handle; a female structure of another one of the two adjacent connecting structures is provided on a side of a the separable adjusting plate proximal to the handle; the plug-in part of said one of the two adjacent connecting structures is convexly provided on a side of the separable adjusting plate distal from the handle facing towards the separable adjusting plate proximal to the handle; the insertion groove of said another one of the two adjacent connecting structures is concavely provided on a side of the separable adjusting plate proximal to the handle facing towards the separable adjusting plate distal from the handle; the lock button of said another one of the two adjacent connecting structures is horizontally movably disposed on a preset sliding groove provided on a top side of the separable adjusting plate proximal to the handle; the pair of lock button restoring springs of said another one of the two adjacent connecting structures is provided in the separable adjusting plate proximal to the handle and in abutting connection with the lock button of said another one of the two adjacent connecting structures.

The insertion groove of said another one of the two adjacent connecting structures is defined by a recess extending down to the separable adjusting plate proximal to the handle from an opening on the top side of the separable adjusting plate proximal to the handle; the preset sliding groove is recessed into a top side surface of the separable adjusting plate proximal to the handle, and is in communication with a portion of the perpendicularly arranged insertion groove away from the separable adjusting plate distal from the handle; a bottom side wall of the preset sliding groove is provided with a pair of openings so that a lower part of the lock button is inserted into the separable adjusting plate proximal to the handle through the pair of openings; the pair of lock button restoring springs of said another one of the two adjacent connecting structures is provided in the separable adjusting plate proximal to the handle and abuts against a pair of inserting ends provided on the lower part of the lock button of said another one of the two adjacent connecting structures.

In comparison to the prior art, the beneficial effects of the present invention are as follows:

Firstly, the present invention provides a plurality of quick assembly and disassembly connecting structures with simple structures realizing easy assembly-disassembly operation and stable connection, which are not easy to disconnect during usage and have a high security level. Secondly, the present invention provides a weight adjustable dumbbell, wherein every two adjacent dumbbell weight plates thereof achieve a separable connection by using two adjacent connecting structures, thereby realizing quick adjustments of dumbbell weight.

DETAILED DESCRIPTION OF THE INVENTION

The following will describe in detail the present invention with reference to the accompanying drawings and embodiments.

Figure 1:
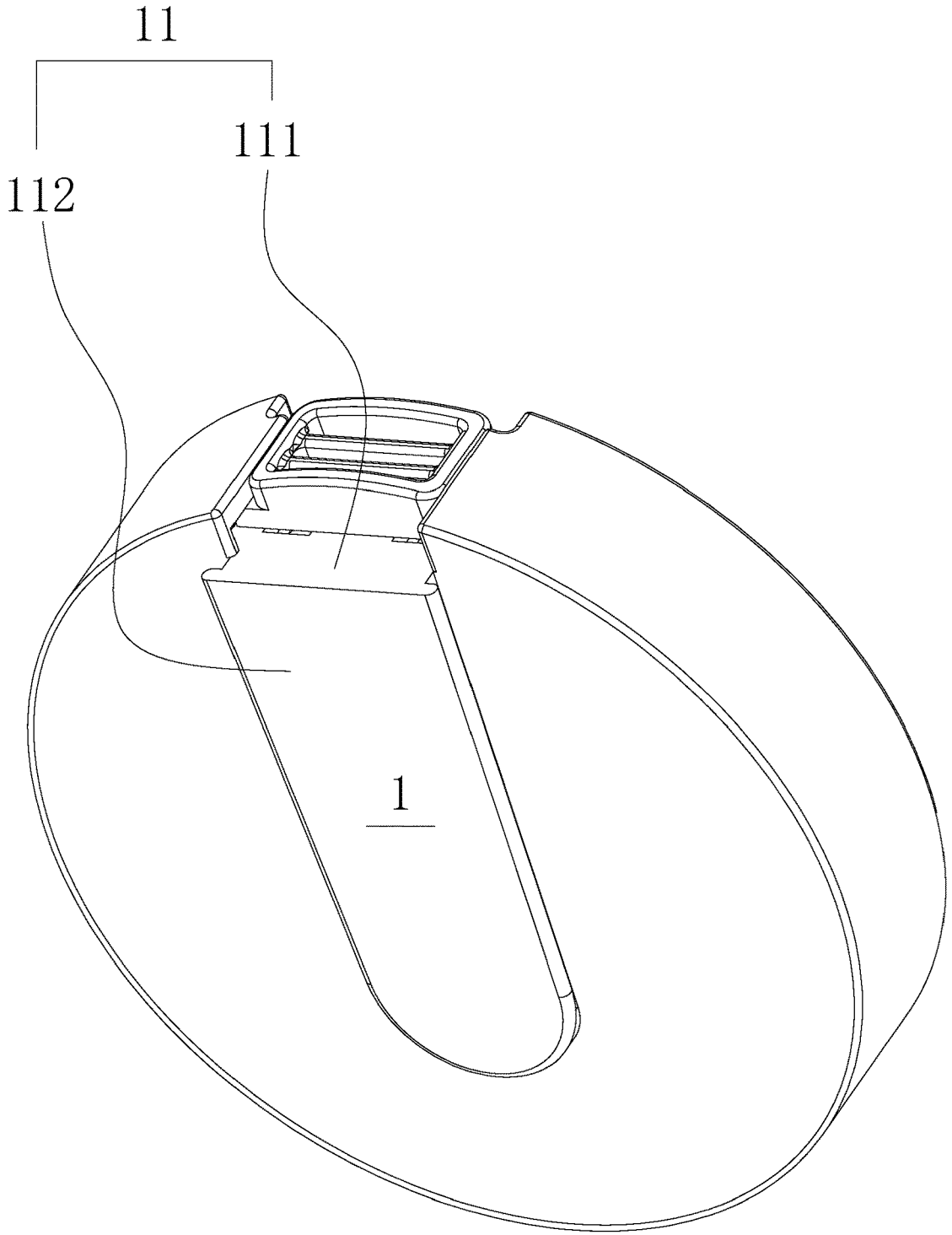
FIG. 1 shows a perspective view of the male structure of the present invention.
Figure 2:
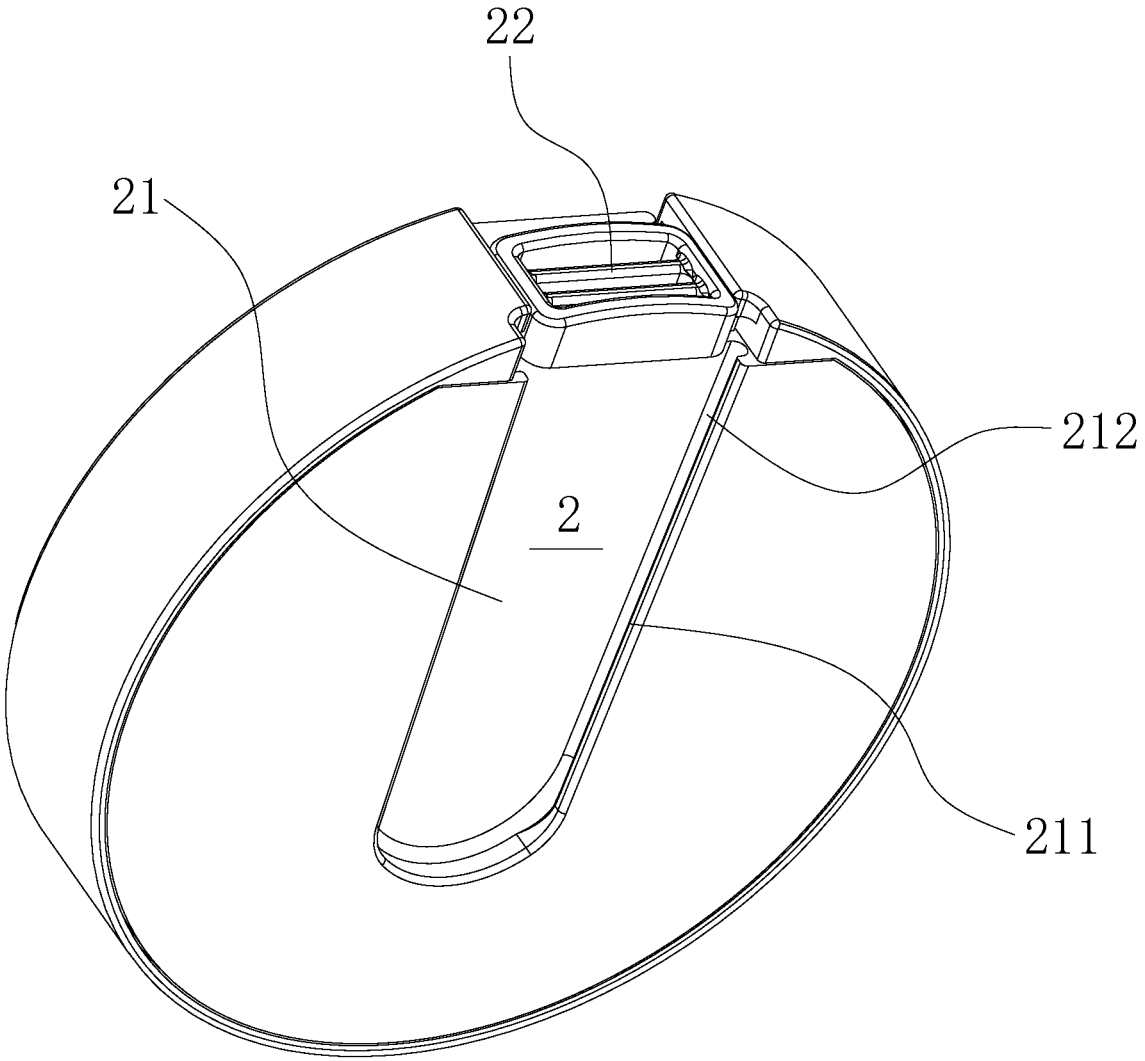
FIG. 2 shows a perspective view of the female structure of the present invention.
Figure 3:
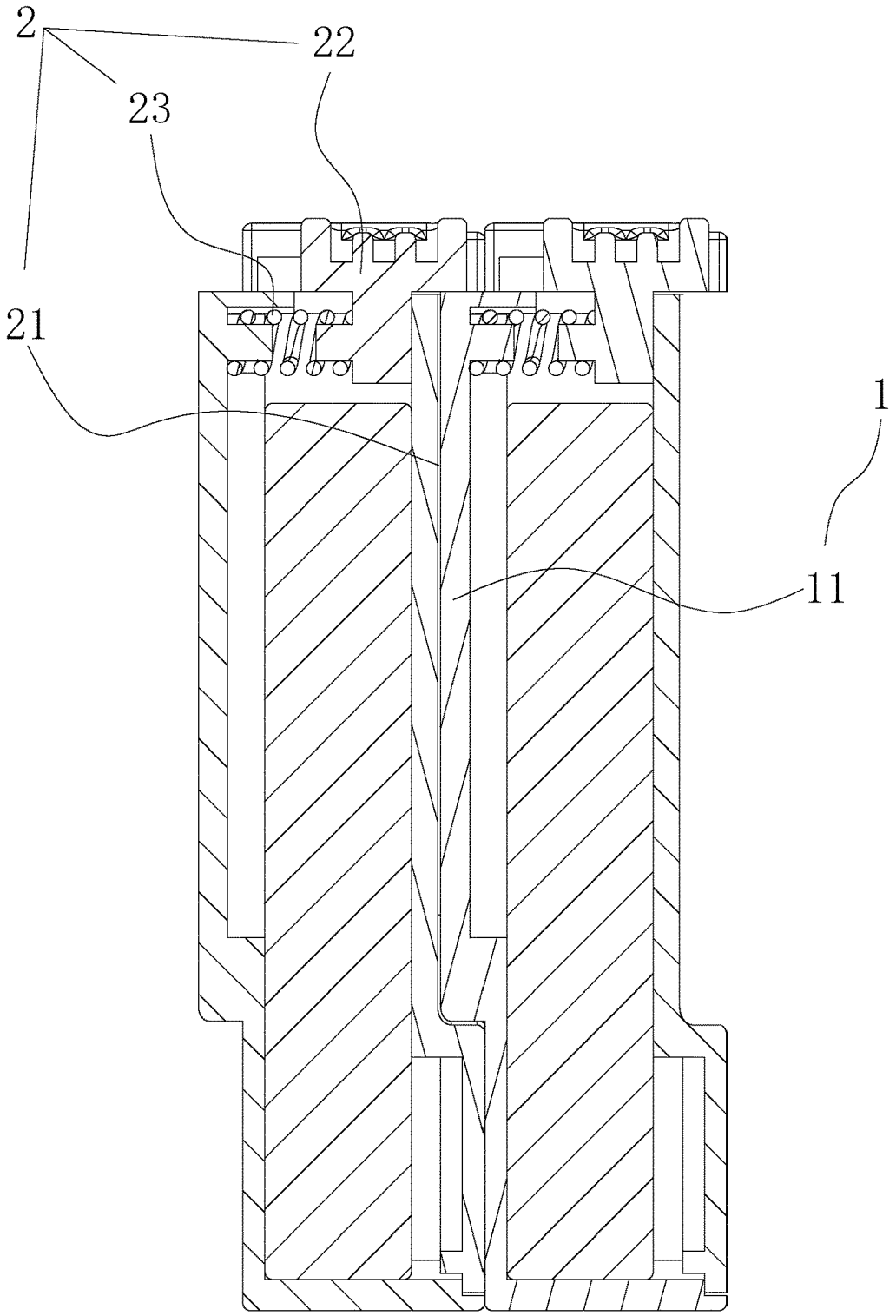
FIG. 3 shows a sectional view of two adjacent quick assembly and disassembly connecting structures of the present invention in an assembled state.
Figure 4:
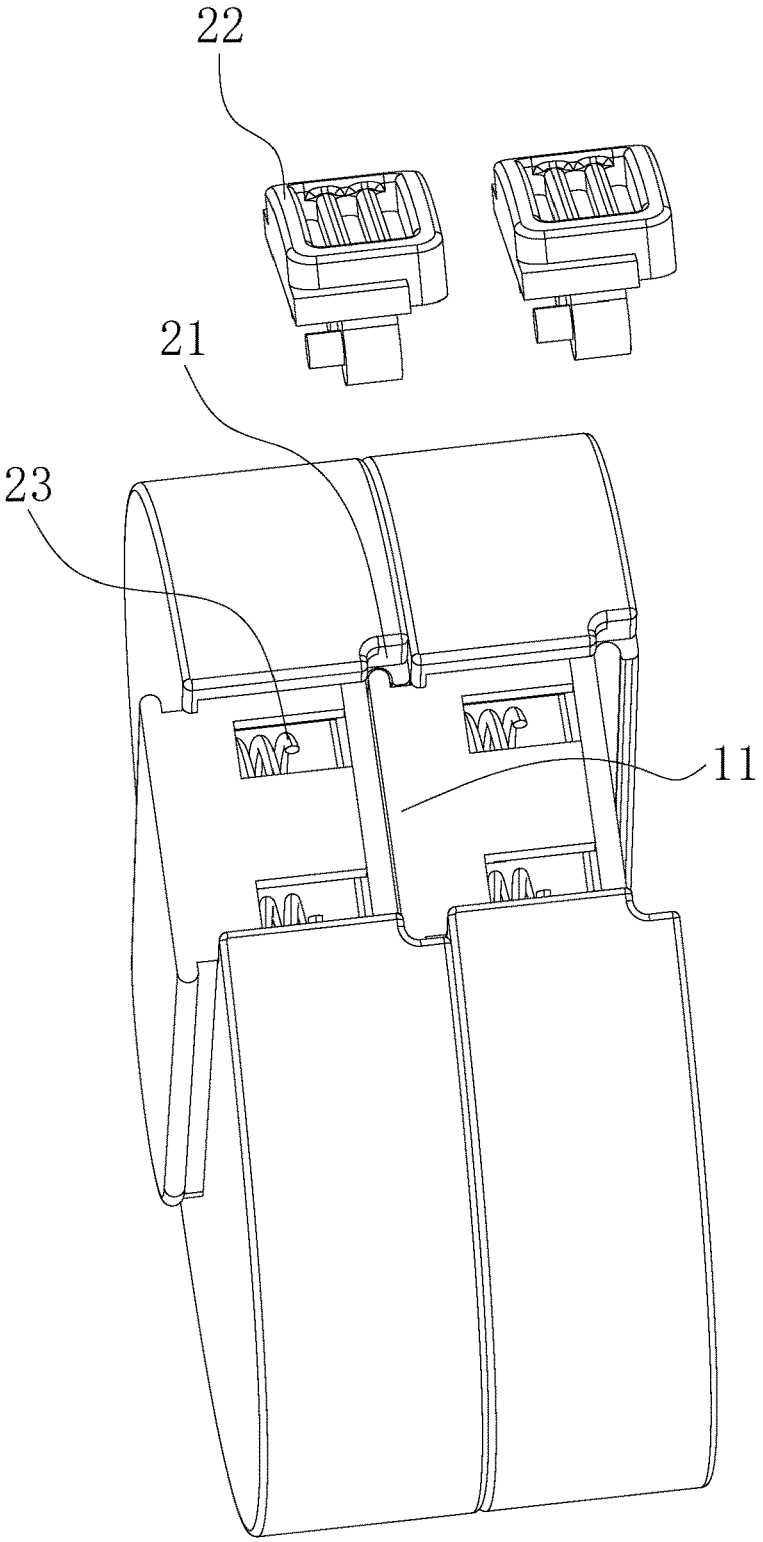
FIG. 4 shows a perspective exploded view of two adjacent quick assembly and disassembly connecting structures of the present invention in an assembled state.

As illustrated in FIGS. 1-4, the present invention provides a plurality of quick assembly and disassembly connecting structures, wherein one side of each connecting structure is provided with a male structure 1, and another side of each connecting structure is provided with a female structure 2. The male structure 1 comprises a plug-in part 11; the female structure 2 comprises an insertion groove 21, a lock button 22, and a pair of lock button restoring springs 23. When two adjacent connecting structures are connected to each other, the plug-in part 11 of one of the two adjacent connecting structures inserts into the insertion groove 21 of another one of the two adjacent connecting structures; the lock button 22 of said another one of the two adjacent connecting structures protrudes to a space above the insertion groove 21 of said another one of the two adjacent connecting structures, and abuts a top side of the plug-in part 11 of said one of the two adjacent connecting structures, so that the plug-in part 11 is blocked from falling off. When pushing the lock button 22 of said another one of the two adjacent connecting structures away from the male structure 1 of said one of the two adjacent connecting structures, the lock button 22 is moved away from the space above the insertion groove 21 of said another one of the two adjacent connecting structures, and the lock button 22 of said another one of the two adjacent connecting structures no longer abuts the top side of the plug-in part 11 of said one of the two adjacent connecting structures, so that the plug-in part 11 is in a separable state; at this time, the plug-in part 11 of said one of the two adjacent connecting structures can be removed out of the insertion groove 21 of said another one of the two adjacent connecting structures; the pair of lock button restoring springs 23 of said another one of the two adjacent connecting structures biases the lock button 22 of said another one of the two adjacent connecting structures towards the male structure 1 of said one of the two adjacent connecting structures such that the lock button 22 of said another one of the two adjacent connecting structures resets towards the male structure 1 of said one of the two adjacent connecting structures when no external force is applied to the lock button 22 of said another one of the two adjacent connecting structures.

As discussed above, the lock button 22 of said another one of the two adjacent connecting structures moves away from or resets towards the male structure 1 of said one of the two adjacent connecting structures by horizontal translation; a moving direction of the lock button 22 of said another one of the two adjacent connecting structures is perpendicular to a moving direction of the plug-in part 11 of said one of the two adjacent connecting structures inserting into the insertion groove 21 of said another one of the two adjacent connecting structures.

As discussed above, the insertion groove 21 of said another one of the two adjacent connecting structures opens at a top side thereof, and also opens at a lateral side towards the male structure 1 of said one of the two adjacent connecting structures; the plug-in part 11 of said one of the two adjacent connecting structures is a tenon fitting a shape of the insertion groove; when connecting the two adjacent connecting structures, the plug-in part 11 of said one of the two adjacent connecting structures inserts into the insertion groove 21 of said another one of the two adjacent connecting structures from top to bottom.

As discussed above, the lateral side of the insertion groove 21 of said another one of the two adjacent connecting structures that opens towards the male structure 1 of said one of the two adjacent connecting structures comprises a narrower opening part 211 and a wider opening part 212 interior to the narrower opening part 211 and widened with respect to the narrower opening part 211; the plug-in part 11 of said one of the two adjacent connecting structures comprises a narrower head part 111 and a wider head part 112 widened with respect to the narrower head part 111, fitted correspondingly to the narrower opening part 211 and the wider opening part 212 of the insertion groove 21 of said another one of the two adjacent connecting structures respectively, so that when the plug-in part 11 of said one of the two adjacent connecting structures inserts into the insertion groove 21 of said another one of the two adjacent connecting structures, the male structure 1 of said one of the two adjacent connecting structures will not be laterally separated from the female structure 2 of said another one of the two adjacent connecting structures.

Figure 5:
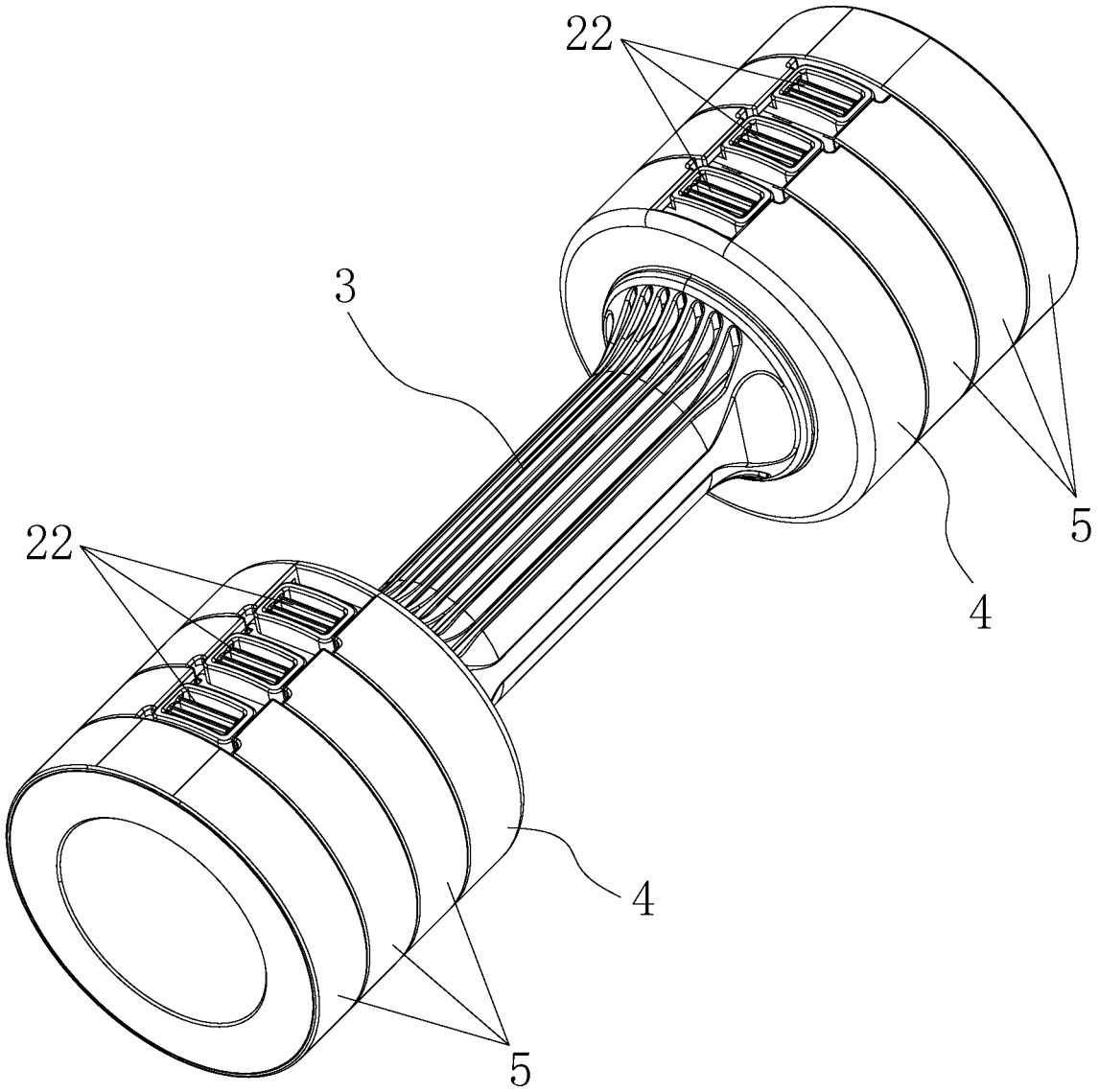
FIG. 5 shows a perspective view of the weight adjustable dumbbell of the present invention.
Figure 6:
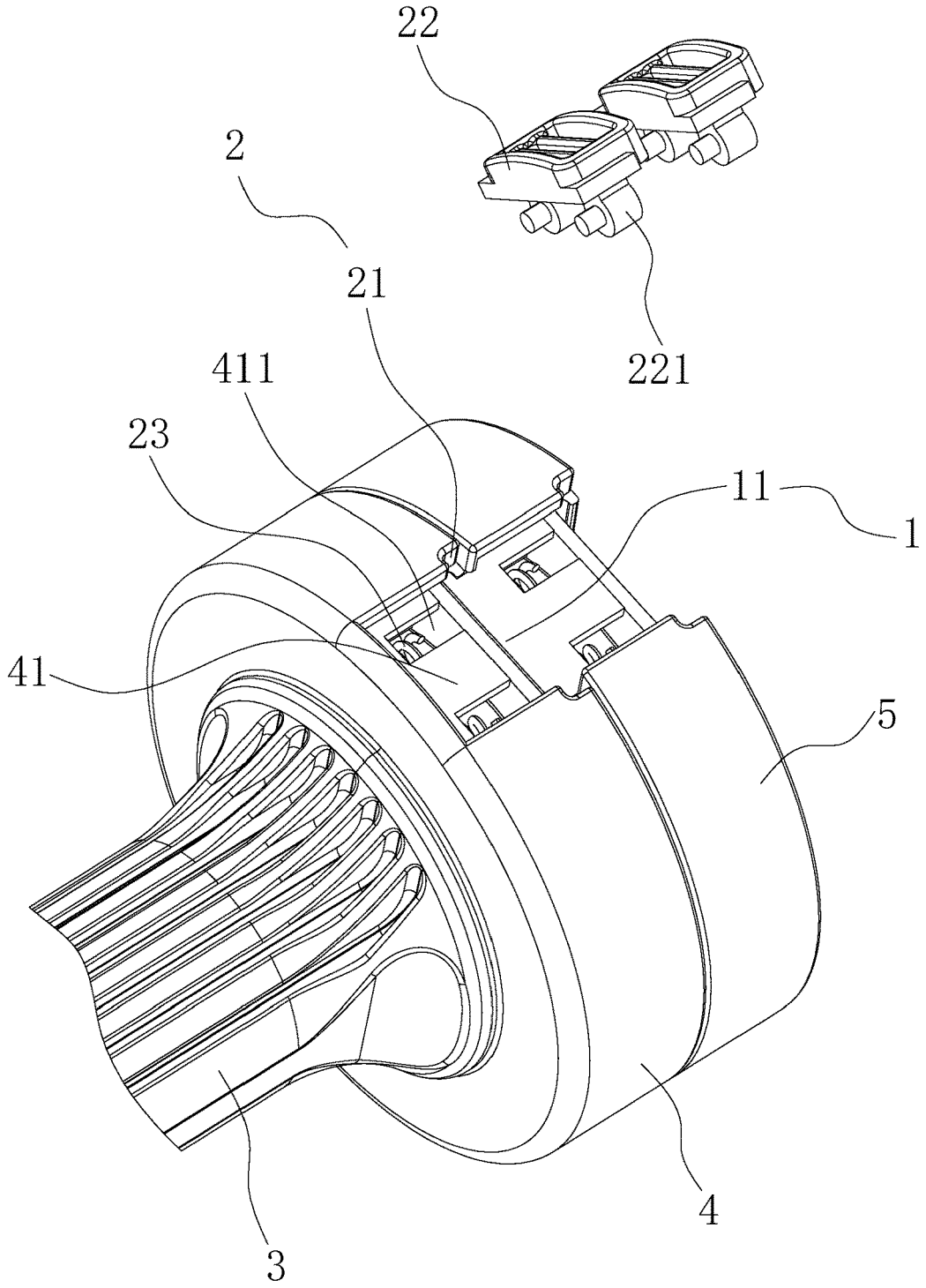
FIG. 6 shows a perspective view of the fixed plate and an adjacent separable adjusting plate in a connected state according to the present invention.
Figure 7:
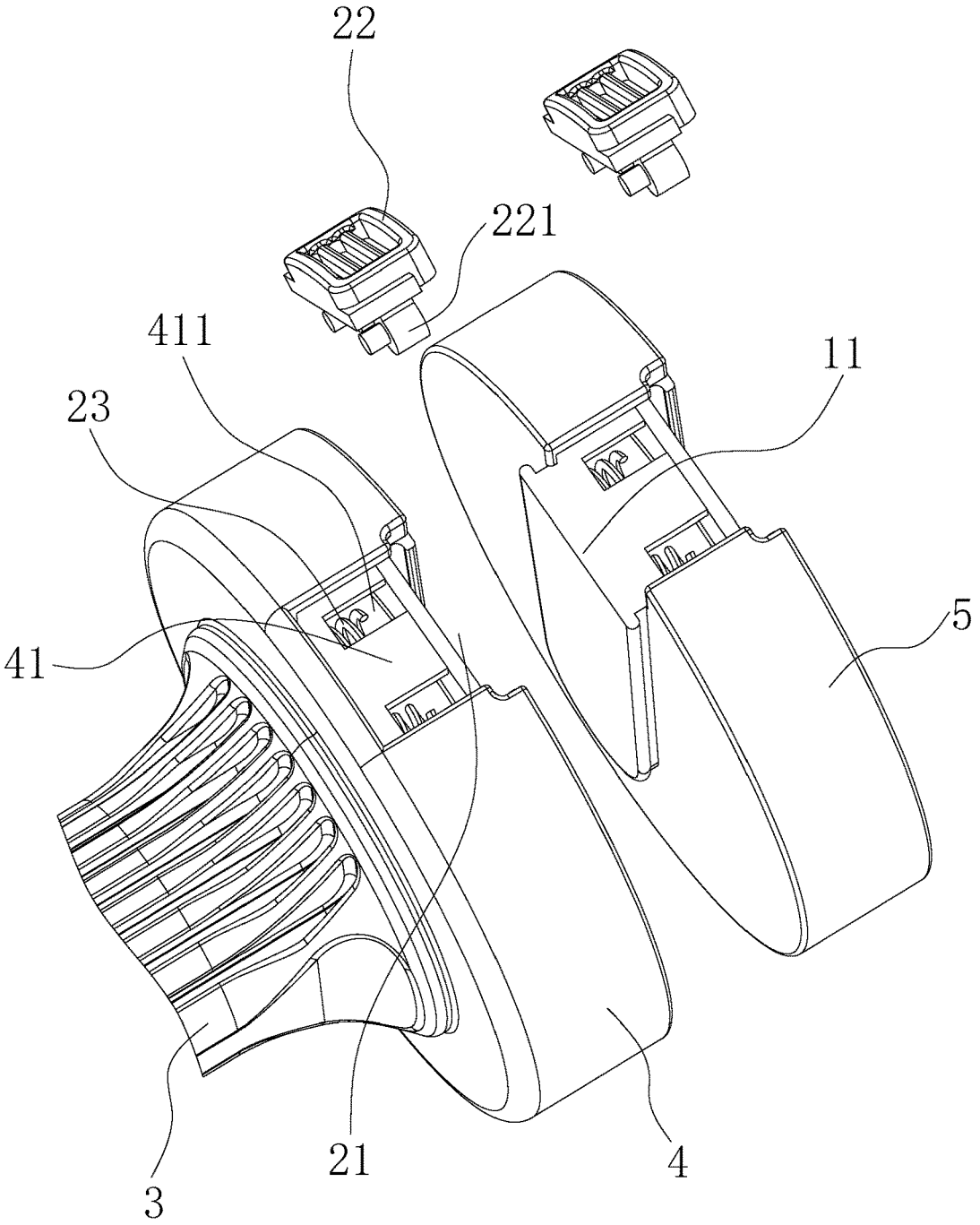
FIG. 7 shows a perspective view of the fixed plate and an adjacent separable adjusting plate in a separated state according to the present invention.
Figure 8:
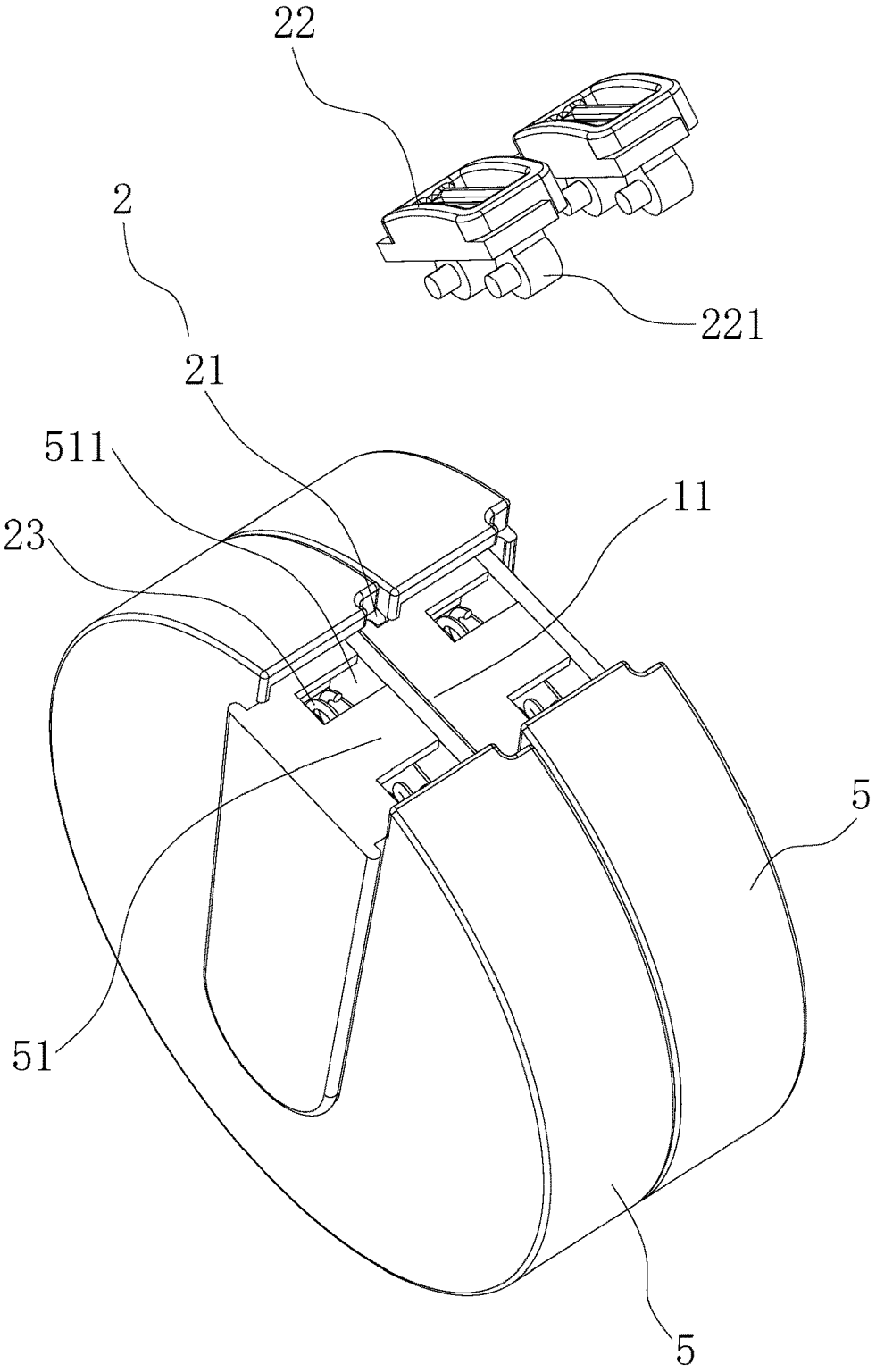
FIG. 8 shows a perspective view of two adjacent separable adjusting plates in a connected state according to the present invention.
Figure 9:
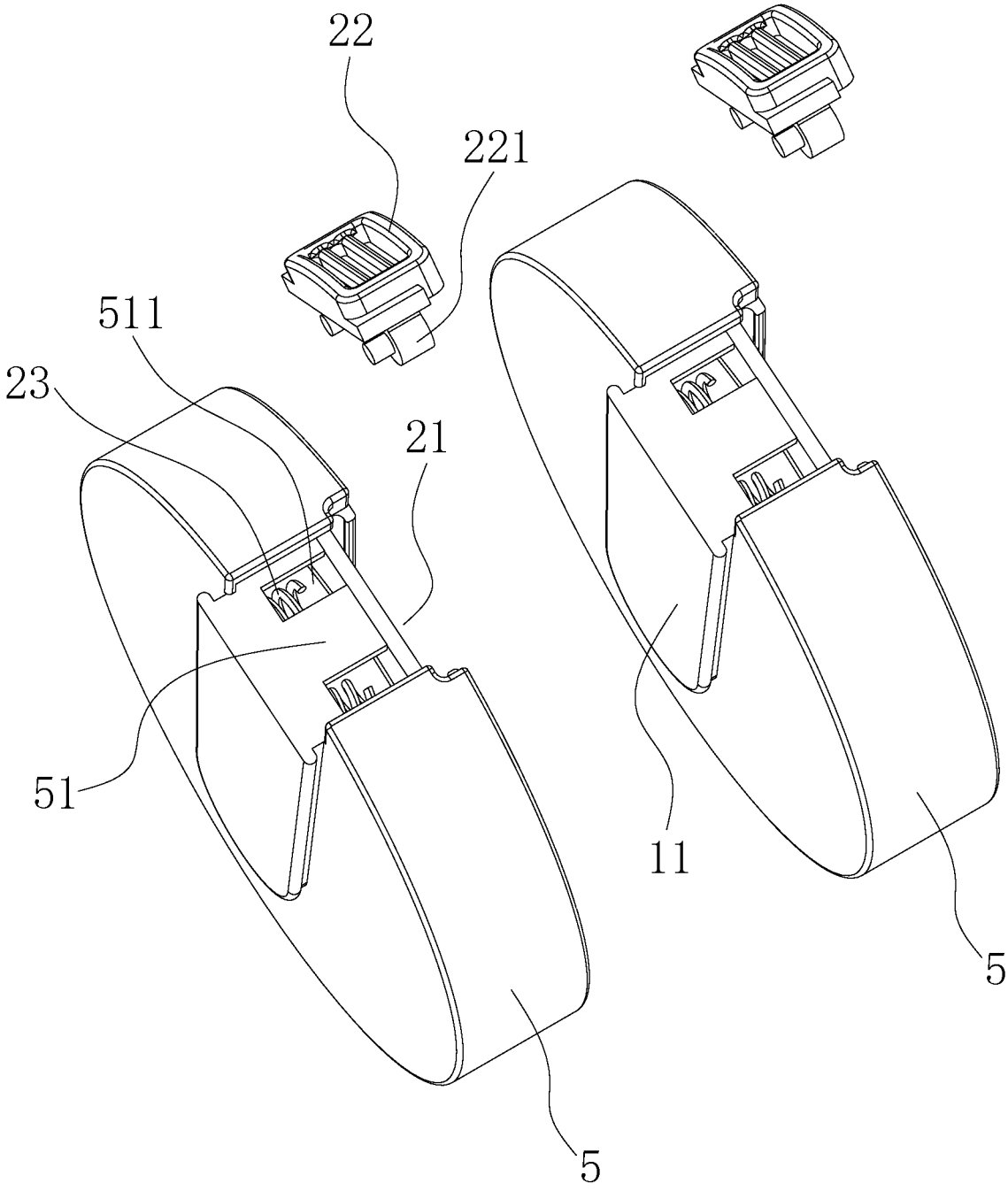
FIG. 9 shows a perspective view of two adjacent separable adjusting plates in a separated state according to the present invention.

As illustrated in FIGS. 5-9, the present invention further provides a weight adjustable dumbbell, comprising a handle 3 and a plurality of dumbbell weight plates respectively on two sides of the handle 3; on each side of the handle 3, a first dumbbell weight plate nearest to the handle 3 is a non-separable fixed plate 4, and all additional dumbbell weight plates arranged on the same side additional to the first dumbbell weight plate are separable adjusting plates 5; the fixed plate 4 and an adjacent separable adjusting plate 5, as well as every two adjacent separable adjusting plates 5, are in each case connected to each other by connecting two adjacent connecting structures.

When the fixed plate 4 and the adjacent separable adjusting plate 5 are connected to each other by connecting two adjacent connecting structures, the male structure 1 of one of the two adjacent connecting structures is provided on a side of the separable adjusting plate 5, and the female structure 2 of another one of the two adjacent connecting structures is provided on a side of the fixed plate 4; specifically, the plug-in part 11 of said one of the two adjacent connecting structures is convexly provided on the side of the separable adjusting plate 5 facing towards the fixed plate 4, and the insertion groove 21 of said another one of the two adjacent connecting structures is concavely provided on the side of the fixed plate 4 facing towards the separable adjusting plate 5; the lock button 22 of said another one of the two adjacent connecting structures is horizontally movably disposed in a preset sliding groove 41 provided on a top side of the fixed plate 4; the pair of lock button restoring springs 23 of said another one of the two adjacent connecting structures is provided in the fixed plate 4 and in abutting connection with the lock button 22 of said another one of the two adjacent connecting structures.

Specifically, the insertion groove 21 of said another one of the two adjacent connecting structures is defined by a recess extending down to the fixed plate 4 from an opening on the top side of the fixed plate 4; the preset sliding groove 41 is recessed into a top side surface of the fixed plate 4, and is in communication with a portion of the perpendicularly arranged insertion groove 21 away from the separable adjusting plate 5; a bottom side wall of the preset sliding groove 41 is provided with a pair of openings 411 so that a lower part of the lock button 22 is inserted into the fixed plate 4 through the pair of openings 411; the pair of lock button restoring springs 23 of said another one of the two adjacent connecting structures is provided in the fixed plate 4 and abuts against a pair of inserting ends 221 provided on the lower part of the lock button 22 of said another one of the two adjacent connecting structures.

A quick assembly and disassembly process between the fixed plate 4 and the adjacent separable adjusting plate 5 is as follows: During disassembly, push the lock button 22 on the fixed plate 4 towards a direction away from the separable adjusting plate 5, so that the lock button 22 no longer abuts a top side of the plug-in part 11 of the separable adjusting plate 5, and then move the separable adjusting plate 5 upward, until the plug-in part 11 of the separable adjusting plate 5 is removed out of the insertion groove 21 of the fixed plate 4, thereby achieving a quick disassembly of the fixed plate 4 and the adjacent separable adjusting plate 5. During assembly, first push the lock button 22 on the fixed plate 4 away from the insertion groove 21 of the fixed plate 4, such that a space is exposed above the insertion groove 21 of the fixed plate 4, and then insert the plug-in part 11 of the separable adjusting plate 5 into the insertion groove 21 of the fixed plate 4 from top to bottom, and release the lock button 22 of the fixed plate 4 to reset the lock button 22 of the fixed plate 4 such that the lock button 22 of the fixed plate 4 abuts the plug-in part 11 of the separable adjusting plate 5, thereby achieving a quick assembly between the fixed plate 4 and the adjacent separable adjusting plate 5.

Furthermore, when every two adjacent separable adjusting plates 5 are connected to each other by connecting two adjacent connecting structures, the male structure 1 of one of the two adjacent connecting structures is provided on a side of the separable adjusting plate 5 distal from the handle 3; a female structure 2 of another one of the two adjacent connecting structures is provided on a side of a the separable adjusting plate 5 proximal to the handle 3; specifically, the plug-in part 11 of said one of the two adjacent connecting structures is convexly provided on a side of the separable adjusting plate 5 distal from the handle 3 facing towards the separable adjusting plate 5 proximal to the handle 3; the insertion groove 21 of said another one of the two adjacent connecting structures is concavely provided on a side of the separable adjusting plate 5 proximal to the handle 3 facing towards the separable adjusting plate 5 distal from the handle 3; the lock button 22 of said another one of the two adjacent connecting structures is horizontally movably disposed on a preset sliding groove 51 provided on a top side of the separable adjusting plate 5 proximal to the handle 3; the pair of lock button restoring springs 23 of said another one of the two adjacent connecting structures is provided in the separable adjusting plate 5 proximal to the handle 3 and in abutting connection with the lock button 22 of said another one of the two adjacent connecting structures.

The insertion groove 21 of said another one of the two adjacent connecting structures is defined by a recess extending down to the separable adjusting plate 5 proximal to the handle 3 from an opening on the top side of the separable adjusting plate 5 proximal to the handle 3; the preset sliding groove 51 is recessed into a top side surface of the separable adjusting plate 5 proximal to the handle 3, and is in communication with a portion of the perpendicularly arranged insertion groove 21 away from the separable adjusting plate 5 distal from the handle 3; a bottom side wall of the preset sliding groove 51 is provided with a pair of openings 511 so that a lower part of the lock button 22 is inserted into the separable adjusting plate 5 proximal to the handle 3 through the pair of openings 511; the pair of lock button restoring springs 23 of said another one of the two adjacent connecting structures is provided in the separable adjusting plate 5 proximal to the handle 3 and abuts against a pair of inserting ends 221 provided on the lower part of the lock button 22 of said another one of the two adjacent connecting structures.

A quick assembly and disassembly process between two adjacent separable adjusting plates 5 is as follows: During disassembly, push the lock button 22 on the separable adjusting plate 5 proximal to the handle 3 towards a direction away from the separable adjusting plate 5 distal from the handle 3, so that the lock button 22 no longer abuts a top side of the plug-in part 11 of the separable adjusting plate 5 distal from the handle 3, and then move the separable adjusting plate 5 distal from the handle 3 upward, until the plug-in part 11 of the separable adjusting plate 5 distal from the handle 3 is removed out of the insertion groove 21 of the separable adjusting plate 5 proximal to the handle 3, thereby achieving a quick disassembly of two adjacent adjusting plates 5. During assembly, first push the lock button 22 on the separable adjusting plate 5 proximal to the handle 3 away from the insertion groove 21 of the separable adjusting plate 5 proximal to the handle 3, such that a space is exposed above the insertion groove of the separable adjusting plate 5 proximal to the handle 3, and then insert the plug-in part 11 of the separable adjusting plate 5 distal from the handle 3 into the insertion groove 21 of the separable adjusting plate 5 proximal to the handle 3 from top to bottom, and release the lock button 22 of the separable adjusting plate 5 proximal to the handle 3 to reset the lock button 22 of the separable adjusting plate 5 proximal to the handle 3 such that the lock button of the separable adjusting plate 5 proximal to the handle 3 abuts against the top side of the plug-in part 11 of the separable adjusting plate 5 distal from the handle 3, thereby achieving a quick assembly of two adjacent separable adjusting plates 5.

It should be understood that, the descriptions above are only the preferable embodiments of the present invention, which are not intended to set a limit to the protection scope of the present invention; equivalent changes and modifications made by those skilled in the art without departing from the essence of the present invention, shall also fall within the protection scope of the present invention.

What is claimed is:

1. A plurality of connecting structures, wherein each connecting structure comprises a male structure and a female structure connectable with each other; the male structure comprises a plug-in part; the female structure comprises an insertion groove, a lock button, and a pair of lock button restoring springs; when two adjacent connecting structures are connected to each other, the plug-in part of one of the two adjacent connecting structures inserts into the insertion groove of another one of the two adjacent connecting structures; the lock button of said another one of the two adjacent connecting structures protrudes to a space above the insertion groove of said another one of the two adjacent connecting structures, and abuts a top side of the plug-in part of said one of the two adjacent connecting structures, so that the plug-in part of said one of the two adjacent connecting structures is blocked from falling off; when pushing the lock button of said another one of the two adjacent connecting structures away from the male structure of said one of the two adjacent connecting structures, the lock button of said another one of the two adjacent connecting structures is moved away from the space above the insertion groove of said another one of the two adjacent connecting structures, and the lock button of said another one of the two adjacent connecting structures no longer abuts the top side of the plug-in part of said one of the two adjacent connecting structures, so that the plug-in part is in a separable state; the pair of lock button restoring springs of said another one of the two adjacent connecting structures biases the lock button of said another one of the two adjacent connecting structures towards the male structure of said one of the two adjacent connecting structures such that the lock button of said another one of the two adjacent connecting structures resets towards the male structure of said one of the two adjacent connecting structures when no external force is applied to the lock button of said another one of the two adjacent connecting structures.

2. The connecting structures of claim 1, wherein the lock button of said another one of the two adjacent connecting structures moves away from or towards the male structure of said one of the two adjacent connecting structures by horizontal translation.

3. The connecting structures of claim 2, wherein a moving direction of the lock button of said another one of the two adjacent connecting structures is perpendicular to a moving direction of the plug-in part of said one of the two adjacent connecting structures inserting into the insertion groove of said another one of the two adjacent connecting structures.

4. The connecting structures of claim 1, wherein the insertion groove of said another one of the two adjacent connecting structures opens at a top side thereof, and also opens at a lateral side towards the male structure of said one of the two adjacent connecting structures; the plug-in part of said one of the two adjacent connecting structures is a tenon fitting a shape of the insertion groove of said another one of the two adjacent connecting structures.

5. The connecting structures of claim 4, wherein the lateral side of the insertion groove of said another one of the two adjacent connecting structures that opens towards the male structure of said one of the two adjacent connecting structures comprises a narrower opening part and a wider opening part interior to the narrower opening part widened with respect to the narrower opening part; the plug-in part of said one of the two adjacent connecting structures comprises a narrower head part and a wider head part widened with respect to the narrower head part, fitted correspondingly to the narrower opening part and the wider opening part of the insertion groove of said another one of the two adjacent connecting structures respectively.

6. A weight adjustable dumbbell, comprising a handle and a plurality of dumbbell weight plates respectively on two sides of the handle; on each side of the handle, a first dumbbell weight plate nearest to the handle is a non-separable fixed plate, and all additional dumbbell weight plates arranged on the same side additional to the first dumbbell weight plate are separable adjusting plates; wherein the fixed plate and an adjacent separable adjusting plate, as well as every two adjacent separable adjusting plates, are in each case connected to each other by connecting two adjacent connecting structures of the connecting structures according to claim 1.

7. The weight adjustable dumbbell of claim 6, wherein when the fixed plate and the separable adjusting plate adjacent to the fixed plate are connected to each other by connecting two adjacent connecting structures, the male structure of said one of the two adjacent connecting structures is provided on a side of the separable adjusting plate, and the female structure of said another one of the two adjacent connecting structures is provided on a side of the fixed plate; wherein the plug-in part of said one of the two adjacent connecting structures is convexly provided on the side of the separable adjusting plate facing towards the fixed plate, and the insertion groove of said another one of the two adjacent connecting structures is concavely provided on the side of the fixed plate facing towards the separable adjusting plate; the lock button of said another one of the two adjacent connecting structures is horizontally movably disposed in a preset sliding groove provided on a top side of the fixed plate; the pair of lock button restoring springs of said another one of the two adjacent connecting structures is provided in the fixed plate and in abutting connection with the lock button of said another one of the two adjacent connecting structures.

8. The weight adjustable dumbbell of claim 7, wherein the insertion groove of said another one of the two adjacent connecting structures is defined by a recess extending down to the fixed plate from an opening on the top side of the fixed plate; the preset sliding groove is recessed into a top side surface of the fixed plate, and is in communication with a portion of the perpendicularly arranged insertion groove away from the separable adjusting plate; a bottom side wall of the preset sliding groove is provided with a pair of openings so that a lower part of the lock button is inserted into the fixed plate through the pair of openings; the pair of lock button restoring springs of said another one of the two adjacent connecting structures is provided in the fixed plate and abuts against a pair of inserting ends provided on the lower part of the lock button of said another one of the two adjacent connecting structures.

9. The weight adjustable dumbbell of claim 6, wherein when every two adjacent separable adjusting plates are connected to each other by connecting two adjacent connecting structures, the male structure of one of the two adjacent connecting structures is provided on a side of the separable adjusting plate distal from the handle; a female structure of another one of the two adjacent connecting structures is provided on a side of a the separable adjusting plate proximal to the handle; the plug-in part of said one of the two adjacent connecting structures is convexly provided on a side of the separable adjusting plate distal from the handle facing towards the separable adjusting plate proximal to the handle; the insertion groove of said another one of the two adjacent connecting structures is concavely provided on a side of the separable adjusting plate proximal to the handle facing towards the separable adjusting plate distal from the handle; the lock button of said another one of the two adjacent connecting structures is horizontally movably disposed on a preset sliding groove provided on a top side of the separable adjusting plate proximal to the handle; the pair of lock button restoring springs of said another one of the two adjacent connecting structures is provided in the separable adjusting plate proximal to the handle and in abutting connection with the lock button of said another one of the two adjacent connecting structures.

10. The weight adjustable dumbbell of claim 9, wherein the insertion groove of said another one of the two adjacent connecting structures is defined by a recess extending down to the separable adjusting plate proximal to the handle from an opening on the top side of the separable adjusting plate proximal to the handle; the preset sliding groove is recessed into a top side surface of the separable adjusting plate proximal to the handle, and is in communication with a portion of the perpendicularly arranged insertion groove away from the separable adjusting plate distal from the handle; a bottom side wall of the preset sliding groove is provided with a pair of openings so that a lower part of the lock button is inserted into the separable adjusting plate proximal to the handle through the pair of openings; the pair of lock button restoring springs of said another one of the two adjacent connecting structures is provided in the separable adjusting plate proximal to the handle and abuts against a pair of inserting ends provided on the lower part of the lock button of said another one of the two adjacent connecting structures.

* * * * *